US005934659A

United States Patent [19]

Johnson

[11] Patent Number: 5,934,659

[45] Date of Patent: Aug. 10, 1999

[54] CAM ACTION STACKED LUMBER CLAMP

[76] Inventor: Steven Johnson, 2335 Sunset, Bishop, Calif. 93514

[21] Appl. No.: 08/748,023

[22] Filed: Nov. 12, 1996

Related U.S. Application Data

[63] Continuation-in-part of application No. 08/429,349, Apr. 26, 1995.

[51] Int. Cl.[6] ..... B25B 1/04

[52] U.S. Cl. ..... 269/237; 211/8; 211/49.1; 248/125.1; 269/239; 269/229

[58] Field of Search ..... 144/2.1, 306; 269/229, 269/237, 239; 248/125.1; 211/8, 49.1

[56] References Cited

U.S. PATENT DOCUMENTS 1,488,868 4/1924 Crimmins ..... 269/237
2,247,519 7/1941 Pace ..... 211/49.1
4,416,104 11/1983 Yamada ..... 269/239
5,181,681 1/1993 Edwards ..... 248/125.1

*Primary Examiner*—W. Donald Bray
*Attorney, Agent, or Firm*—Timothy T. Tyson

[57] ABSTRACT

A clamp (200) for clamping stacked lumber (72) to prevent twisting and bending of the lumber or theft is disclosed. A horizontal member (274) goes under the lumber and is attached to a vertical member (214) at the back. A pressure bar (206) hinged to the vertical member goes on top of the lumber. When the front of the pressure bar is lowered to the top of stack, an automatic lock (222) retains the rear of the pressure bar at a fixed position on the vertical member. A brace (204) between the front of the pressure bar and the vertical member holds the pressure bar in position. The effective length of the brace is increased by means of a lever operated cam (202) which places 2000 pounds of pressure on the front of the pressure bar to clamp the stack.

12 Claims, 11 Drawing Sheets

FIG. 7
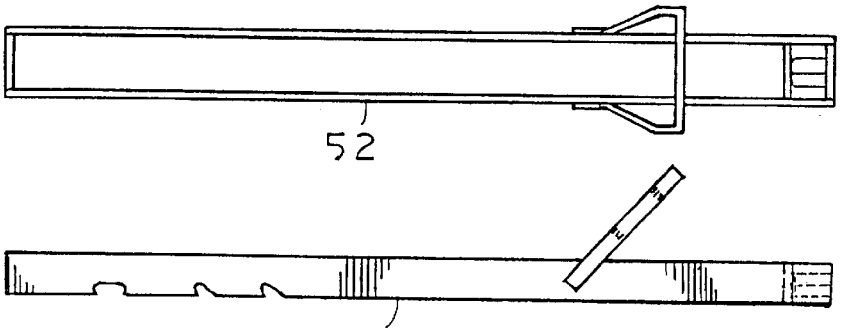
FIG. 8
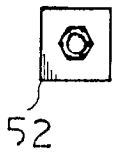
FIG. 9
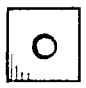
FIG. 6
FIG 5
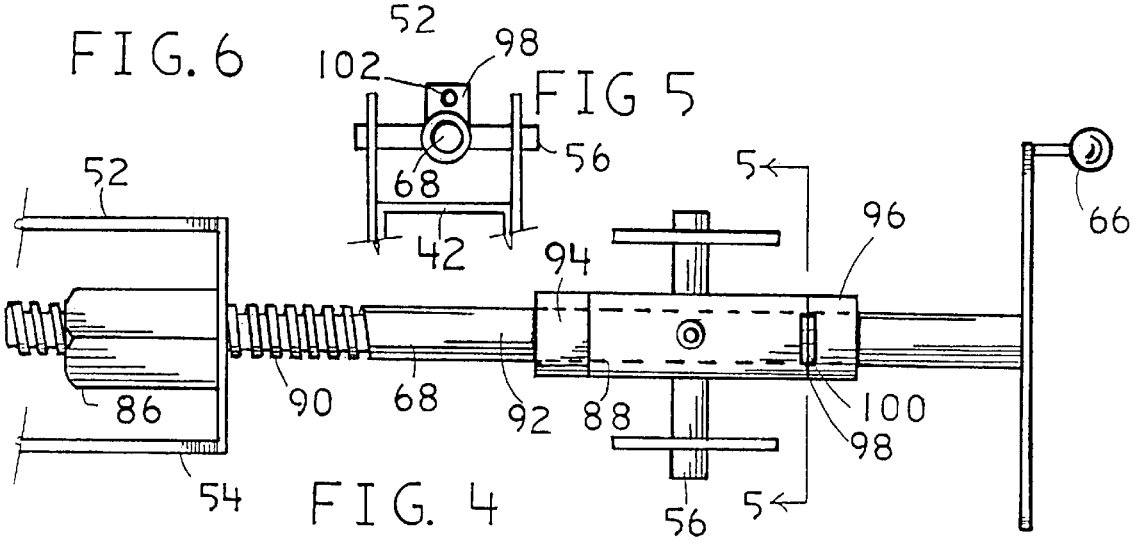
FIG. 4
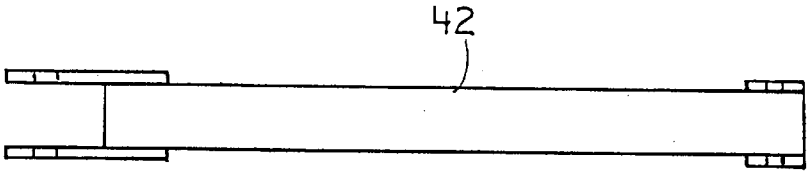
FIG. 12
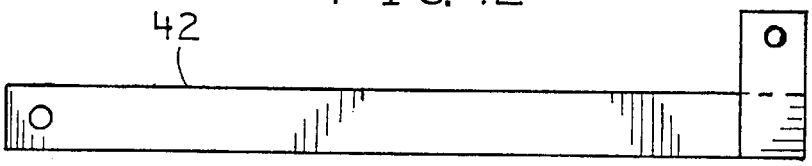
FIG. 11
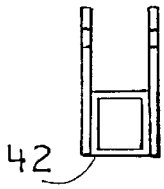
FIG. 13

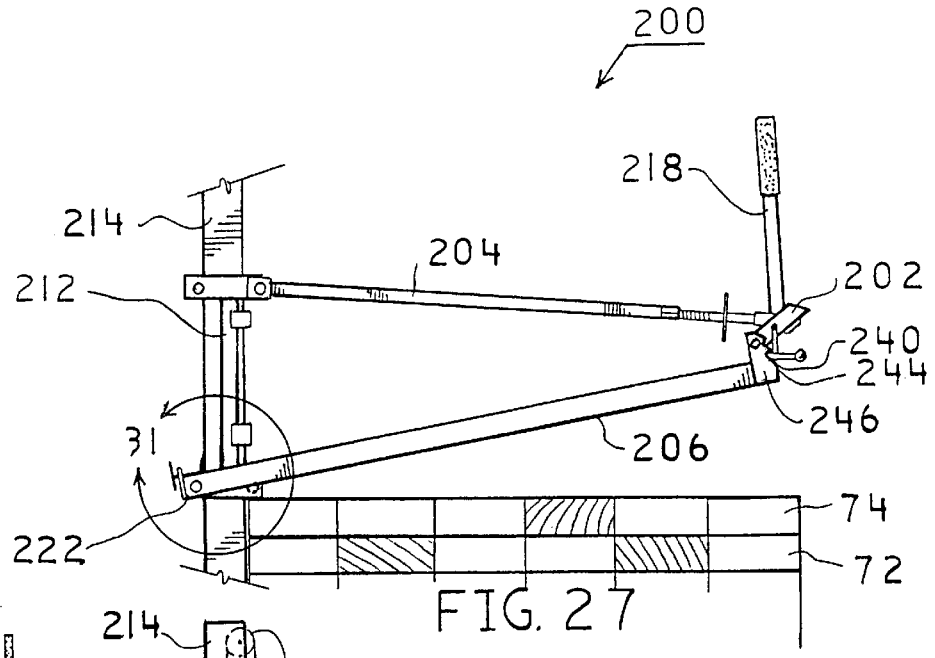
FIG. 27
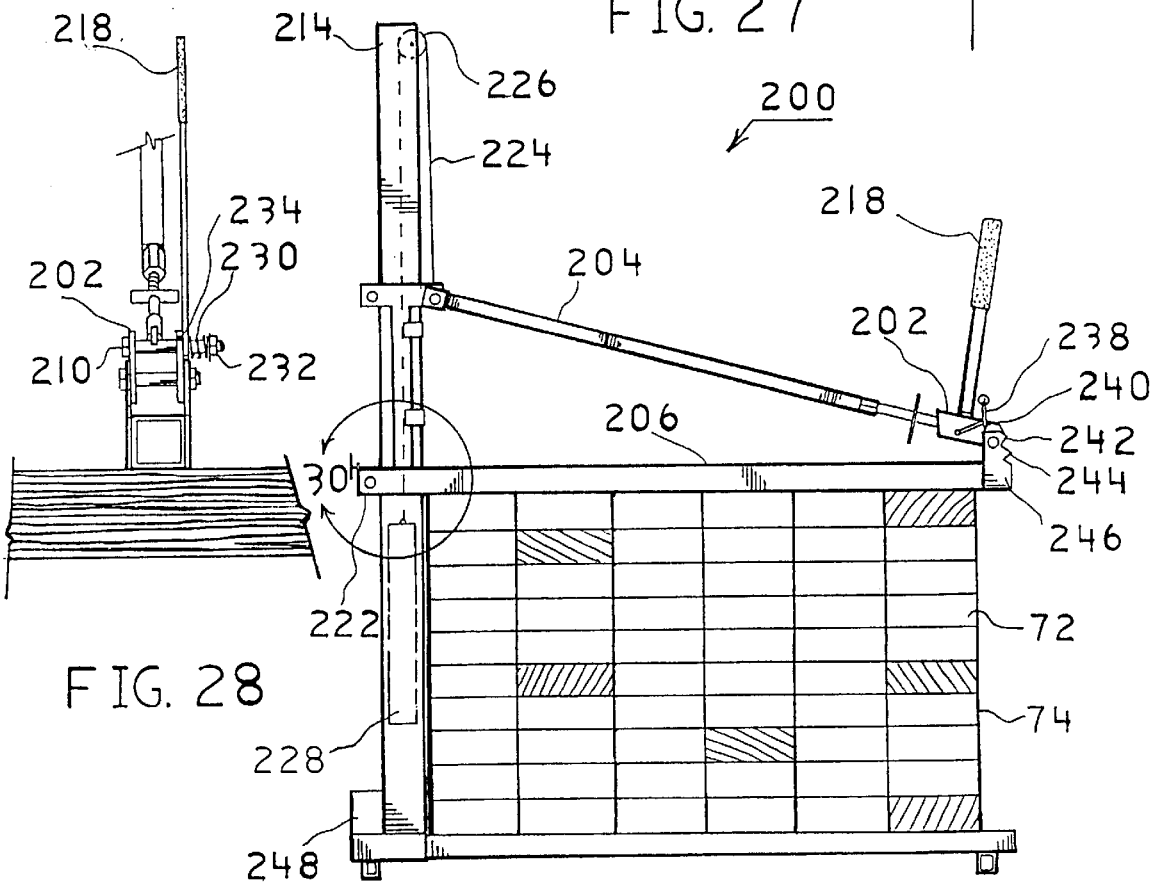
FIG. 28
FIG. 26

CAM ACTION STACKED LUMBER CLAMP

CROSS REFERENCE TO RELATED APPLICATION

This is a continuation-in-part of U.S. patent application Ser. No. 08/429,349, filed on Apr. 26, 1995, the contents of which are incorporated herein by reference.

TECHNICAL FIELD

The present invention pertains to lumber clamps, and more particularly to a large clamp for holding a stack of lumber in place to keep the boards from twisting and bending as they dry.

BACKGROUND ART

Several devices for stacking and holding lumber to keep it from twisting and bending have been developed. The problem is particularly acute with green lumber which has recently been cut and has a high water content. Once a board has become twisted or bent, it is difficult or impossible to use. Losses of 20–30% of the boards in a stack of lumber to twisting or bending are not uncommon. The solution is to hold the stack of lumber or to lay the boards in special racks so they cannot twist or bend. Then as they dry, they dry straight.

U.S. Pat. No. 2,181,356 describes the problem and shows a rack for storing piled lumber at an angle in order to minimize the "crooking, splitting, bowing, checking, and cupping" of the lumber as it dries. A reduction in the loss of lumber to these factors from 20% to 1% is claimed. One problem with the rack is that the boards must be carefully inserted into the rack one at a time which is time consuming and expensive. The lumber comes from the sawmill in rectangular stacks with the boards laid horizontally. If the rack is to be used, the stacks must be broken down and the boards inserted into the rack individually. Another problem with the rack is that each different size of lumber requires different notched base supports in order to hold the boards at the proper angle. The rack in U.S. Pat. No. 2,247,519 also holds the lumber at an angle in order to use the force of gravity to hold each board both vertically and horizontally to keep it straight.

U.S. Pat. No. 3,504,404 discloses a device for holding stacked lumber in place during movement of the stack for shipment and could be used to hold lumber during storage as it dries although access would be awkward requiring removal of a top chain or beam. A somewhat similar arrangement is shown in U.S. Pat. No. 4,107,958 which is designed to protect large sheets of building materials from theft by the use of side clamps. U.S. Pat. No. 4,730,734 discloses another clamping device for protecting building materials or other goods from theft. The horizontal clamping bars are held on a vertical column which keeps them out of the way of the lumber or other goods when they are lifted.

None of the prior art rack devices provides retention of a unit stack of lumber to keep the boards straight. None of the prior art clamping devices provides easy application to a stack of lumber while allowing quick access to the lumber when lifted.

DISCLOSURE OF INVENTION

The present invention is directed to a clamp for a stack of lumber which is easily applied when desired and lifted for access to the top pieces of lumber. A horizontal member goes under the lumber and is attached to a vertical member at the back. A pressure bar hinged to the vertical member goes on top of the lumber. The front of the pressure bar is pushed down by a brace extending to the vertical member to hold the lumber in place.

In accordance with a preferred embodiment of the invention, the rear hinge is movable vertically on the vertical member in order to allow the pressure bar to rest on top of lumber stacks having different heights. A means is provided for extending the length of the brace.

In accordance with an important aspect of the invention, the extension means is a cam rotatably coupled between the brace and pressure bar front ends. When the cam is rotated, the front end of the pressure bar moves. When the rear of the cam is rotated below a centerline along the cam and brace, the pressure bar is clamped with respect to the horizontal member.

In accordance with another important aspect of the invention, a lock automatically locks the rear of the pressure bar with respect to the vertical member when the front of the pressure bar is lowered toward a horizontal position and automatically releases the rear when the front of the pressure bar is lifted.

In accordance with another important aspect of the invention, a counterweight inside the vertical member balances the weight of the pressure bar assembly allowing the operator to easily lift the assembly up and down on the vertical member as desired.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 4 is an enlarged top plan view of the area within the arrow 4 of FIG. 2B with the pressure bar omitted and the handle rotated 90° for clarity of illustration;

FIG. 5 is a partial view along line 5—5 of FIG. 4 with the upper portion of the pressure bar added;

FIG. 6 is an enlarged side elevational view of the brace of FIG. 2A;

FIG. 7 is a top plan view of FIG. 6;

FIG. 8 is a view along the line 8—8 of FIG. 7;

FIG. 9 is a partial right end view of FIG. 7 from the side opposite FIG. 8;

FIG. 11 is an enlarged side elevational view of the pressure bar of FIG. 2A;

FIG. 12 is a top plan view of FIG. 11;

FIG. 13 is a right end elevational view of FIG. 11;

FIG. 26 is a left side elevational view of the cam activated clamp of FIG. 25 clamping a stack of lumber;

FIG. 27 is a partial left side elevational view of the upper portion of the clamp showing the pressure bar raised to release the stack of lumber of FIG. 26;

FIG. 28 is an enlarged partial front elevational view of FIG. 26;

MODES FOR CARRYING OUT THE INVENTION

Figure 1:
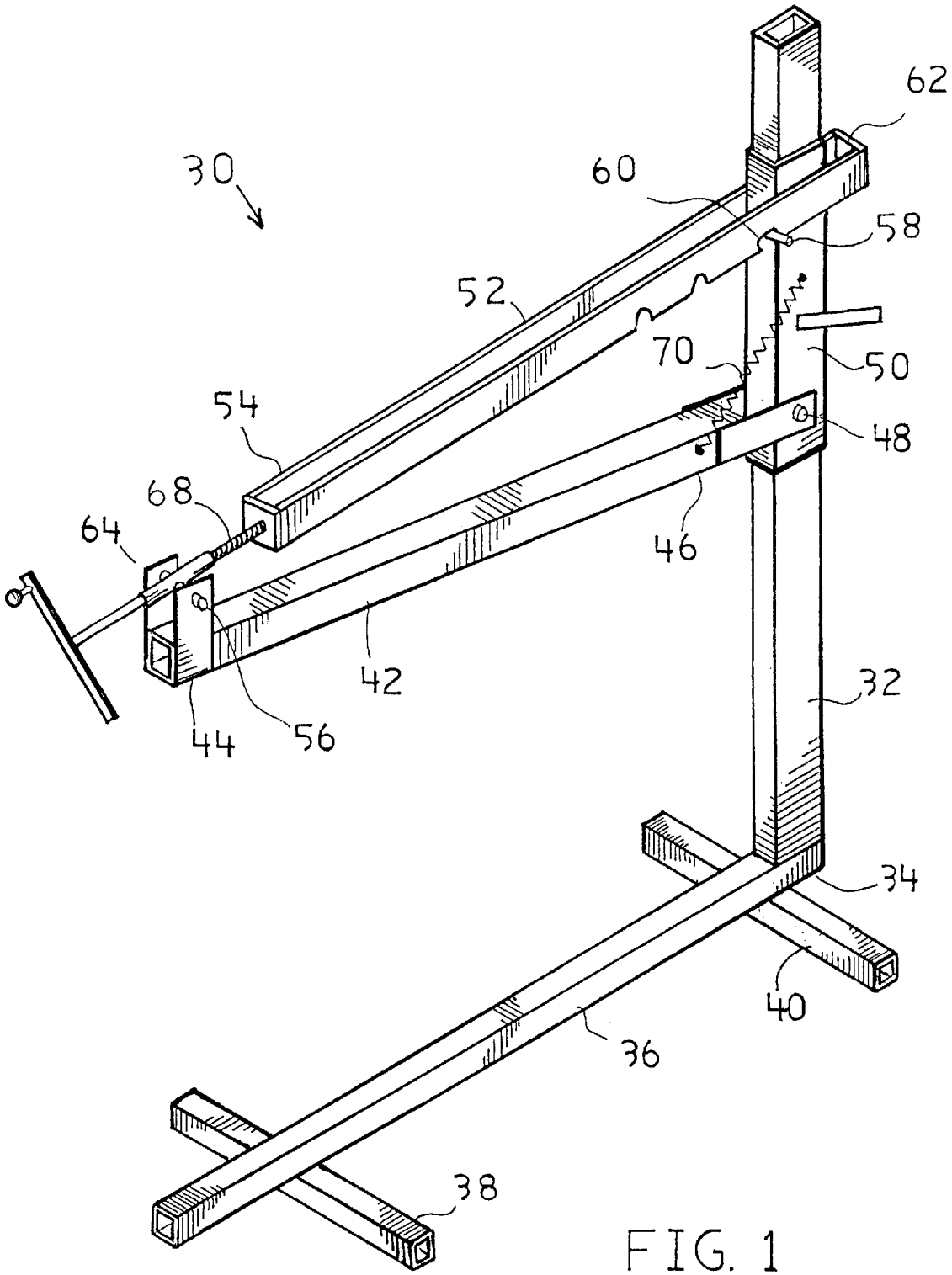
FIG. 1 is a front, top, right side, perspective view of a stacked lumber clamp in accordance with the present invention.

Referring initially to FIG. 1, a front, top, right side, perspective view of a stacked lumber clamp in accordance with the present invention, generally designated 30, is shown. The clamp 30 is preferably fabricated of steel and has a main stand including a vertical member 32 welded at a right angle to the rear end 34 of a horizontal member 36. Cross stands 38 and 40 are welded to the horizontal member 36 at right angles allowing the clamp 30 to stand upright by itself. A pressure bar 42 having front end 44 and rear end 46 is movably coupled to the vertical member 32 by a rear hinge 48 at the rear end of the pressure bar. The rear hinge is mounted on a sleeve 50 which slides on the vertical member 32 providing a means for moving the rear hinge 48 and pressure bar 42 vertically on the vertical member in order to fit different sized stacks of lumber which are positioned between the horizontal member 36 and the pressure bar 42 as shown in FIG. 2A.

Figure 2B:
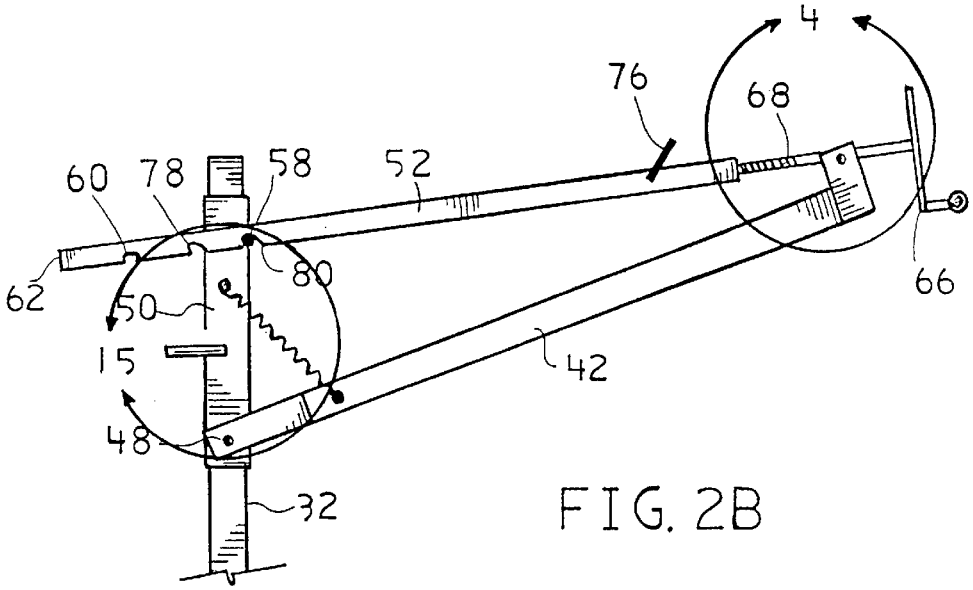
FIG. 2B is a partial left side elevational view of the upper portion of the clamp showing the pressure bar raised to release the stack of lumber of FIG. 2A.
Figure 2A:
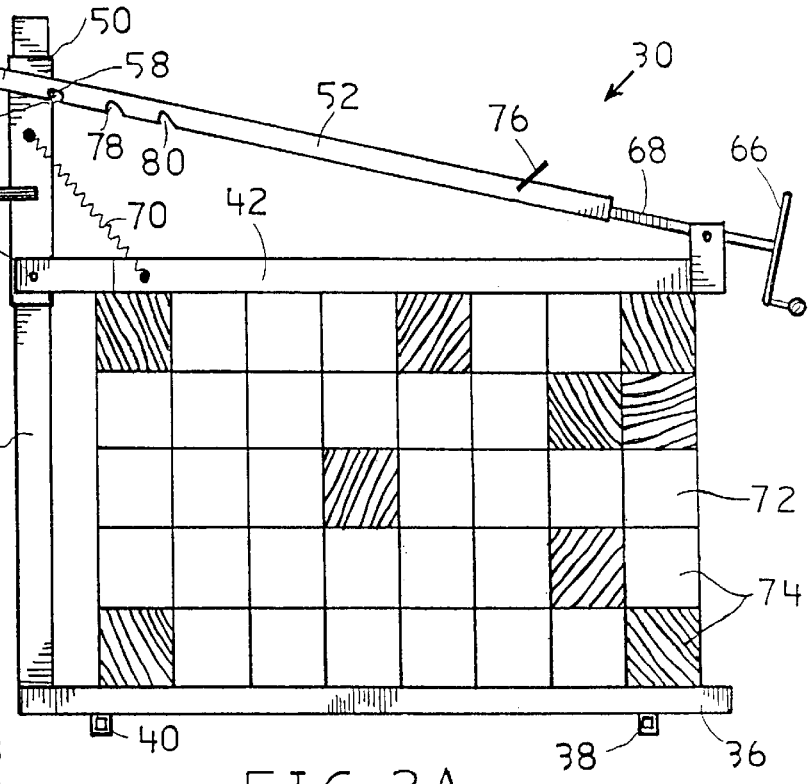
FIG. 2A is a left side elevational view of the clamp clamping a stack of lumber.

A brace 52 provides a means for holding the pressure bar 42 in a fixed position with respect to the horizontal member 36 as shown in FIG. 2A and also to lift the pressure bar off of the lumber stack when access to the lumber is desired as shown in FIG. 2B. The front end 54 of the brace 52 is coupled to the front end 44 of the pressure bar 42 by a front hinge 56. A pin 58 on the sleeve 50 and slot 60 on the underside of the brace provide a means for retaining the rear end 62 of the brace on the vertical member 32. Adjustment of the position of the pressure bar 42 with respect to the horizontal member 36 is provided by a compression crank 64 including a handle 66 and threaded shaft 68. The compression crank provides a means for extension of the brace 52 to adjusting the position of the front end 44 of the pressure bar 42 with respect to the horizontal member 36. When the clamp 30 is placed over a stack of lumber as shown in FIG. 2A and the length of the brace 52 is extended by rotation of the compression crank 64, significant clamping force is exerted on the lumber stack between the pressure bar 42 and the horizontal member 36 keeping all of the individual boards in position. When the clamp 30 is not on a lumber stack as shown in FIG. 1, a spring 70 provides a means for lifting or biasing the pressure bar front end 44 away from the horizontal member 36 facilitating insertion of the clamp around a new stack of lumber.

FIG. 2A is a left side elevational view of the clamp 30 clamping a stack of lumber 72 including individual boards 74. The height of the clamp is sufficient to allow it to be inserted around a full stack of lumber as it comes from the sawmill. Access to the boards is gained by raising the pressure bar 42 as shown in FIG. 2B. FIG. 2B is a partial left side elevational view of the upper portion of the clamp 30. As the boards are used out of the stack either at a lumberyard or construction site, the pressure bar is progressively lowered with the sleeve 50 to match the top level of the remaining boards 74.

The construction of the sleeve 50, pressure bar 42, and brace 52 provides two significant advantages to the clamp 30. The pressure bar 42 is easily released and applied to a stack of lumber by rotating the handle 66. As shown in FIG. 2A, the handle has been used to turn the threaded shaft 68 to compress the pressure bar 42 against the lumber 72. When the handle 66 is turned in the opposite direction, the pressure of the brace 52 on the pin 58 is released allowing the operator to lift the rear end 62 of the brace off of the pin 58 through the slot 60 using the hand lift 76. Aiding the operator is the spring 70 which partially compensates for the weight of the pressure bar and brace. As the pressure bar 42 pivots upward on the rear hinge 48, the lower side of the brace 52 slides along the pin 58 until the pin engages a notch 78 or a notch 80 further from the brace rear end 62 than the slot 60 to hold the pressure bar 42 away from the lumber 72 as shown in FIG. 2B.

Figure 16:
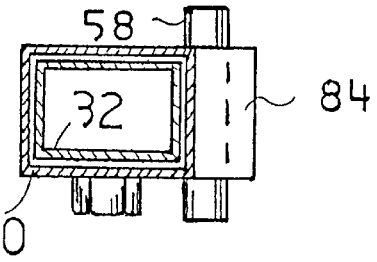
FIG. 16 is a top plan view of FIG. 15.

The other significant advantage is that the whole assembly easily moves up and down on the vertical member 32 in order to match the height of the wood stack as the height changes. The sleeve 50 is slightly larger than the vertical member 32 as shown in FIG. 16. The clearance between them allows the sleeve to be moved up and down by the operator when desired. Alternatively when the operator is no longer holding the pressure bar 42 and brace 52 and the pressure bar is not touching a stack of lumber, the sleeve 50 is canted on the vertical member 32 by the weight of the pressure bar and brace to create enough friction to hold the assembly at a fixed height on the vertical member.

The means for retaining the sleeve at a fixed position on the vertical member 32 is further facilitated by a friction member in the form of the pin 58 for pressing against the vertical member 32 when the effective length of the brace 52 is extended by the threaded shaft 68. As better shown in the enlarged view of the sleeve 50 in FIG. 15, the pin 58 touches the vertical member 32 through a slot 82 when the brace is extended. The slot 82 is sized to permit passage of the pin 58 to the vertical member during the compression of the pressure bar against a stack of lumber. When the pressure bar is no longer against a stack of lumber, the pressure bar moves down due to gravity pulling the brace and pin 58 away from the vertical member 32 into a fixed member in the form of a pin holder 84 attached to the sleeve 50 which restricts the movement of the pin away from the vertical member. The pin holder 84 and pin 58 then hold the pressure bar 42 and brace 52 in a position that easily allows the operator to move the assembly up and down on the vertical member 32 as shown in FIG. 2B.

Figure 3:
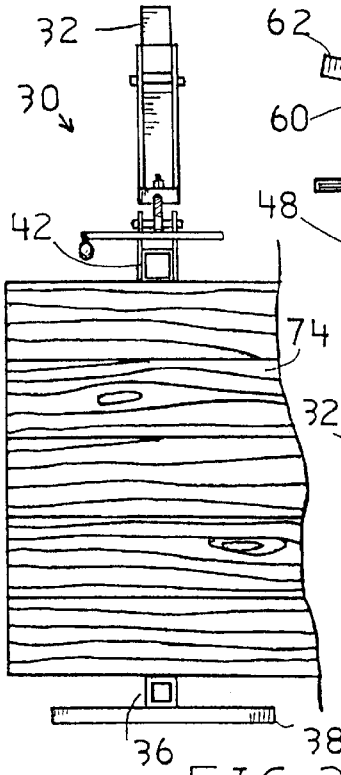
FIG. 3 is a front elevational view of FIG. 2A.

FIG. 3 is a front elevational view of FIG. 2A. The horizontal member 36, vertical member 32, and pressure bar 42 are in the same plane. The cross stand 38 holds the vertical member vertical even when the clamp 30 is not clamping a lumber stack 74.

FIG. 4 is an enlarged top plan view of the area within the arrow 4 of FIG. 2B with the pressure bar omitted and the handle rotated 90° for clarity of illustration showing the means for extension of the effective length of the brace required to compress the pressure bar against the lumber stack. The threaded shaft 68 is rotatably coupled between the brace front end 54 and the front hinge 56. The handle 66 is a hand crank that provides a means for rotating the threaded shaft in a threaded nut 86 which is welded to the brace 52 and a crank sleeve 88 welded to the front hinge 56. The threaded shaft has a threaded portion 90 that engages the threaded nut and a non-threaded portion 92 that rotates in the crank sleeve. Stops 94 and 96 attached to the threaded shaft abut the crank sleeve 88 to keep the threaded shaft 68 in place and push the pressure bar up and down.

Hasp 98 welded to the crank sleeve 88 and hasp 100 welded to the threaded shaft 68 provide a means to attach a padlock to prevent an unauthorized user from rotating the threaded shaft to gain access to the lumber stack. The clamp 30 can thereby be used to protect lumber from theft as well as to keep the lumber from twisting and bending as it dries.

FIG. 5 is a partial view along line 5—5 of FIG. 4 with the upper portion of the pressure bar 42 added. The hole 102 in hasp 98 is matched by a hole in the hasp on the threaded shaft 68 which together allow a padlock to secure the threaded shaft against unauthorized rotation.

Figure 10:
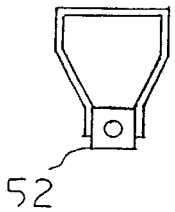
FIG. 10 is a right end view of FIG. 6.

FIGS. 6, 7, 8, 9, and 10 are various enlarged views of the brace 52 of FIG. 2A. FIG. 6 is a side elevational view, FIG. 7 is a top plan view, FIG. 8 is a view along the line 8—8 of FIG. 7, FIG. 9 is a partial right end view of FIG. 7 from the side opposite FIG. 8, and FIG. 10 is a right end view of FIG. 6.

Similarly, FIGS. 11, 12, and 13 are various enlarged views of the pressure bar 42 of FIG. 2A. FIG. 11 is a side elevational view, FIG. 12 is a top plan view, and FIG. 13 is a right end elevational view.

Figure 14:
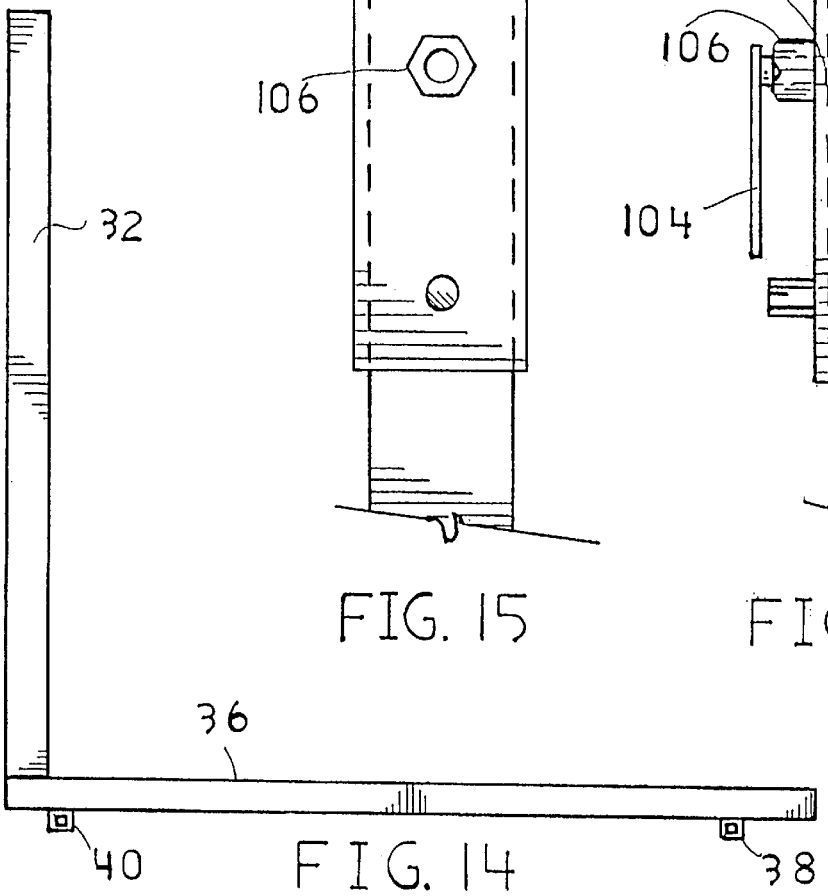
FIG. 14 is a side elevational view of the horizontal and vertical members of FIG. 2A.

FIG. 14 is a side elevational view of the main stand of the clamp showing only the horizontal and vertical members 36 and 32, respectively, and the cross stands 38 and 40.

Figure 15:
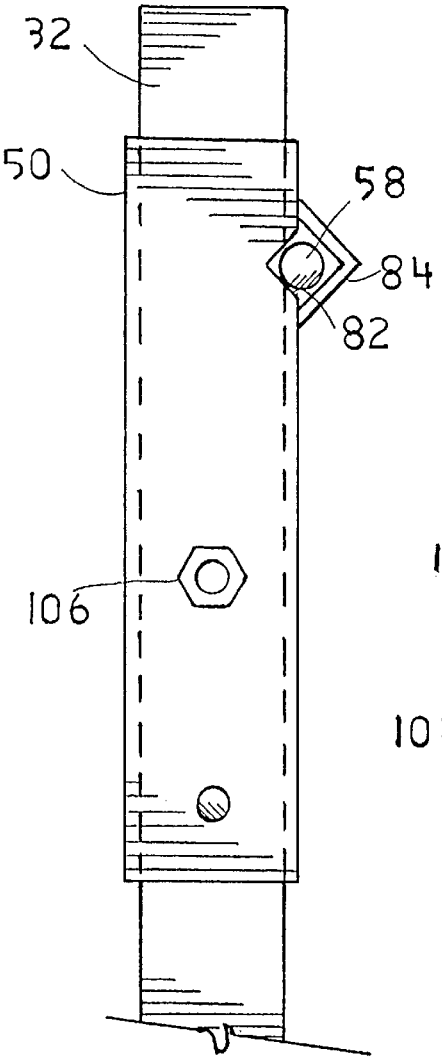
FIG. 15 is a partial enlarged view of the area within circle 15 of FIG. 2B.
Figure 17:
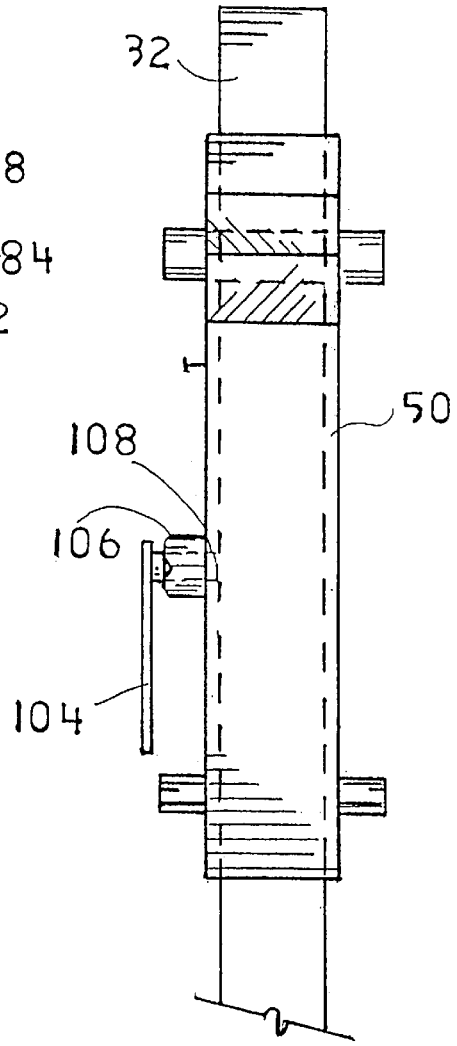
FIG. 17 is a front elevational view of FIG. 15.

FIGS. 15 is a partial enlarged view of the area within circle 15 of FIG. 2B and was discussed above in conjunction with FIGS. 2A and 2B. FIG. 16 is a top plan view of FIG. 15 and was also discussed above. FIG. 17 is a front elevational view of FIG. 15. A lock handle 104, lock handle nut 106 welded to the sleeve 50, and hole 108 through the sleeve provide a means for locking the sleeve at a desired position on the vertical member 32. The sleeve is locked at the position by rotating the lock handle into the nut until the tip 110 of the lock handle abuts the vertical member.

Figure 18:
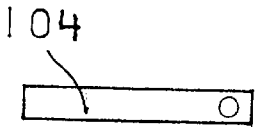
FIG. 18 is a top plan view of the lock handle of FIG. 17.
Figure 19:
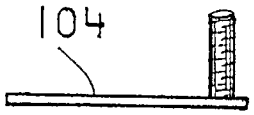
FIG. 19 is a side elevational view of FIG. 18.

FIGS. 18 and 19 show the lock handle 104 separately. FIG. 18 is a top plan view and FIG. 19 is a side elevational view.

Figure 20:
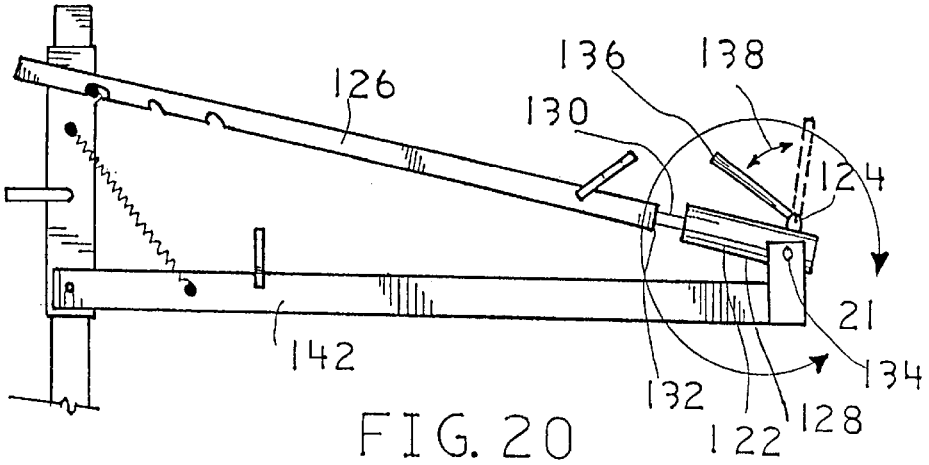
FIG. 20 is a partial side elevational view of a second hydraulic embodiment similar to FIG. 2A.

FIG. 20 is a partial side elevational view of a second hydraulic embodiment of the stacked lumber clamp, generally designated 120. The view of FIG. 20 is similar to FIG. 2A with the bottom of the main stand omitted. Elements not discusses with specific reference to FIG. 20 are the same as in FIG. 2A. A piston 122 and pump 124 provide the means for extension of the brace 126 in this embodiment and are substituted for the threaded shaft and handle of the previous embodiment. The piston includes a cylinder 128 and a piston shaft 130 having a piston shaft end 132 movable with respect to the cylinder. The piston shaft end 132 is welded to the brace 126 and the cylinder is welded to the front hinge 134. The piston would work equally well with the couplings reversed. The pump handle 136 and internal pump attached to the handle work in a manner well known in the art when moved in the arc represented by the arrow 138. When the pump handle 136 is pumped, a means is provided for moving the piston shaft end 132 with respect to the cylinder 128. The pump is preferable a hydraulic pump but could be any means for creating hydraulic pressure to move the piston shaft end. Pneumatic pressure could also be use.

Figure 21:
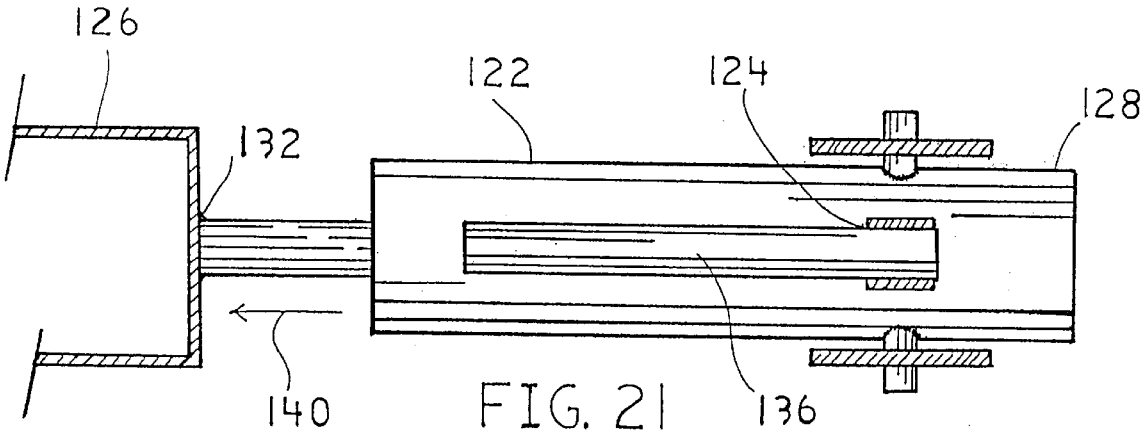
FIG. 21 is an enlarged top plan view of the area within arrow 21 of FIG. 20 with the pressure bar omitted for clarity of illustration.

FIG. 21 is an enlarged top plan view of the area within arrow 21 of FIG. 20 with the pressure bar omitted for clarity of illustration. The view is similar to FIG. 4 with respect to function. The piston 122 and pump 124 provide a means for extension of the effective length of the brace 126. The piston shaft end 132 is welded to the brace 126 and the cylinder is welded to the front hinge 134. When the handle 136 is pumped, the brace 126 moves away from the piston 122 in the direction of the arrow 140.

Figure 22:
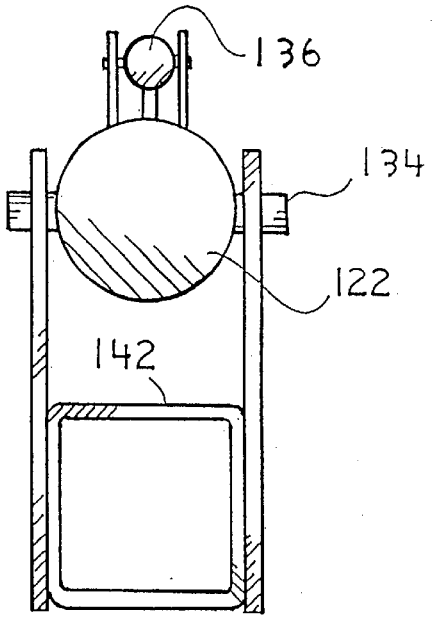
FIG. 22 is a partial front elevational view of FIG. 20.

FIG. 22 is a partial front elevational view of FIG. 20 showing the pressure arm 142, piston 122, pump handle 136, and front hinge 134.

Figure 23:
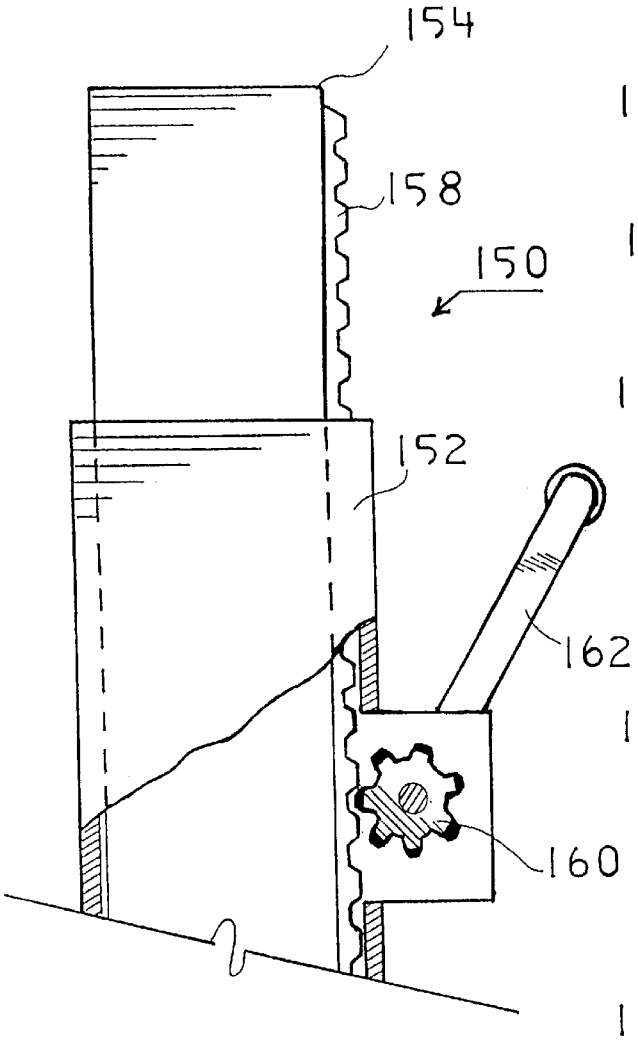
FIG. 23 is an enlarged cutaway side elevational view of a rack and pinion embodiment substituting for the pin embodiment shown in FIG. 15.
Figure 24:
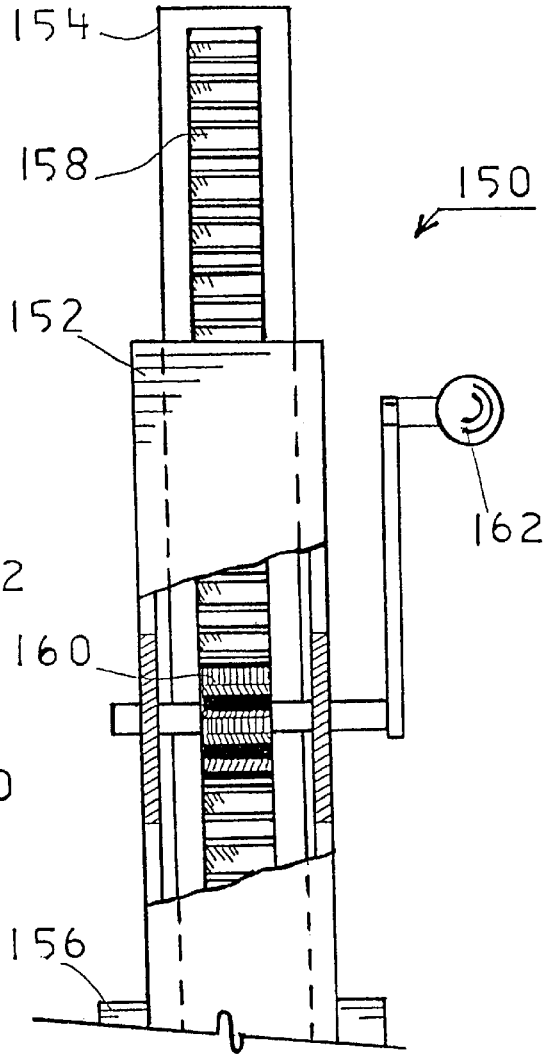
FIG. 24 is a cutaway front elevational view of FIG. 23.

FIG. 23 is an enlarged cutaway side elevational view of a rack and pinion embodiment 150 for holding the sleeve at a desired position on the vertical member substituting for the pin embodiment for holding the sleeve shown in FIG. 15. FIG. 24 is a cutaway front elevational view of FIG. 23. As in the previous embodiments, a sleeve 152 provides a movable member on the vertical member 154 that is coupled to a rear hinge 156 for moving the rear hinge along the vertical member to adjust for the varying heights of the stacked lumber. The rack 158 is welded to the vertical member 154 and the pinion 160 is rotatably mounted to the sleeve 152. As the pinion crank 162 is rotated, the pinion 160 moves up or down the rack 158 moving the sleeve 152 thereby providing a means for selectively moving the rear hinge 156 vertically on the vertical member.

Figure 25:
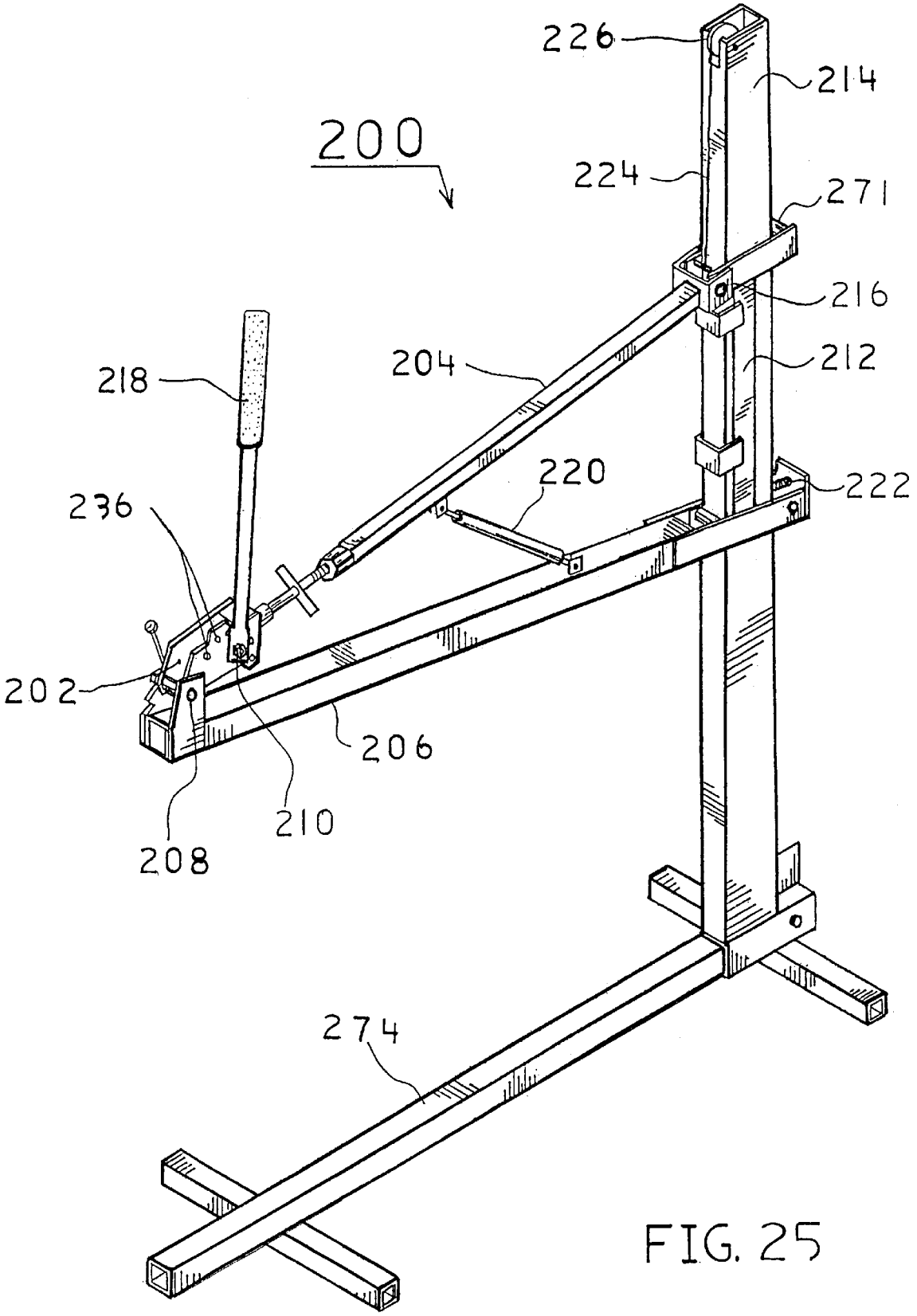
FIG. 25 is a front, top, right side, perspective view a cam activated embodiment.

FIG. 25 is a top right side perspective view of a fourth embodiment of the stacked lumber clamp, generally designated 200, which utilizes an over center cam 202. The clamp 200 of FIG. 25 is similar to clamp 30 of FIG. 1.

Elements not discusses with specific reference to FIG. 25 are the same as in FIG. 1.

The cam 202 provides the means for extension of the brace 204 in this embodiment and is substituted for the threaded shaft and handle of the embodiment 30 shown in FIG. 1. The cam 202 is rotatably coupled to the pressure bar 206 by a bolt 208 and the brace 204 by a bolt 210. The opposite end of the brace 204 is rotatably coupled to a sleeve 212 on the vertical member 214 by a bolt 216. A handle 218 is movably attached to the cam 202 also by bolt 210 for providing leverage for an operator of the clamp 200 to move the cam between the clamped position shown in FIG. 26 and the unclamped position shown in FIG. 27. In FIG. 25, the cam 202 is shown in the clamped position.

The cam action locks over center because of the arrangement between the various elements. If a center line is drawn between bolt 208 on the end of the pressure bar 206 to bolt 216 on the sleeve 212, the axis of the center bolt 210 is below the center line when the clamp 200 is locked. Any additional upward pressure on the pressure bar 206 applies additional force downward on bolt 210 locking the clamp harder. When the clamp 200 is to be released, the operator must move the end of cam 202 with the center bolt 210 upward through the center line briefly making the brace 204 effectively longer and clamping the clamp 200 harder. Once the bolt 210 is above the center line, the clamp 200 is totally released. Any further upward force on the pressure bar 206 causes the pressure bar and brace 204 to move up. A stabilizer 220 similar to a shock absorber dampens the upward movement of the pressure bar and brace when the cam passes over center.

Another new feature of this embodiment is an automatic lock 222 on the rear end of the pressure bar 206. Movement of the entire pressure bar 206 up and down is used in order to match the heights of various stacks of lumber being clamped. Once the height of the stack is matched, the sleeve 212 is locked in place vertically at the desired position on the vertical member 214 prior to the cam 202 being set.

On the previous embodiment 30 shown in FIG. 1, a threaded lock handle 104 shown in FIGS. 17–19 is used to hold the sleeve 50 in place vertically on the vertical member 32. In the embodiment 150 shown in FIGS. 23 and 24, a rack and pinion is used to hold the sleeve 152 in place vertically.

Figure 30:
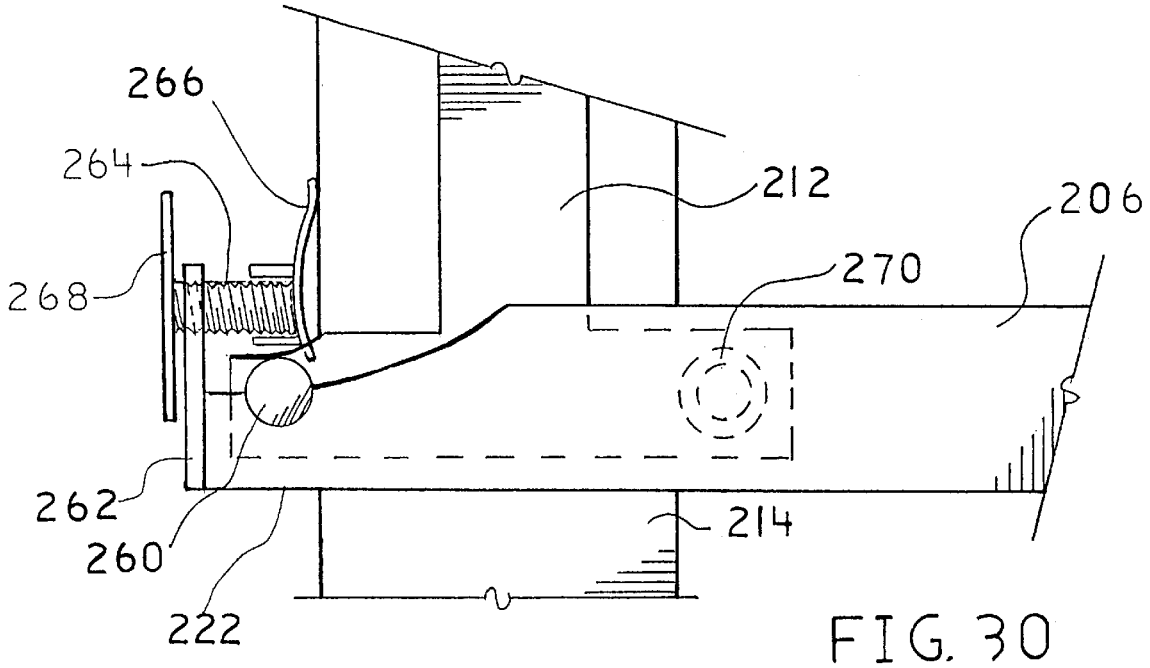
FIG. 30 is an enlarged left side elevational view of the area within the arrow 30 of FIG. 26.
Figure 31:
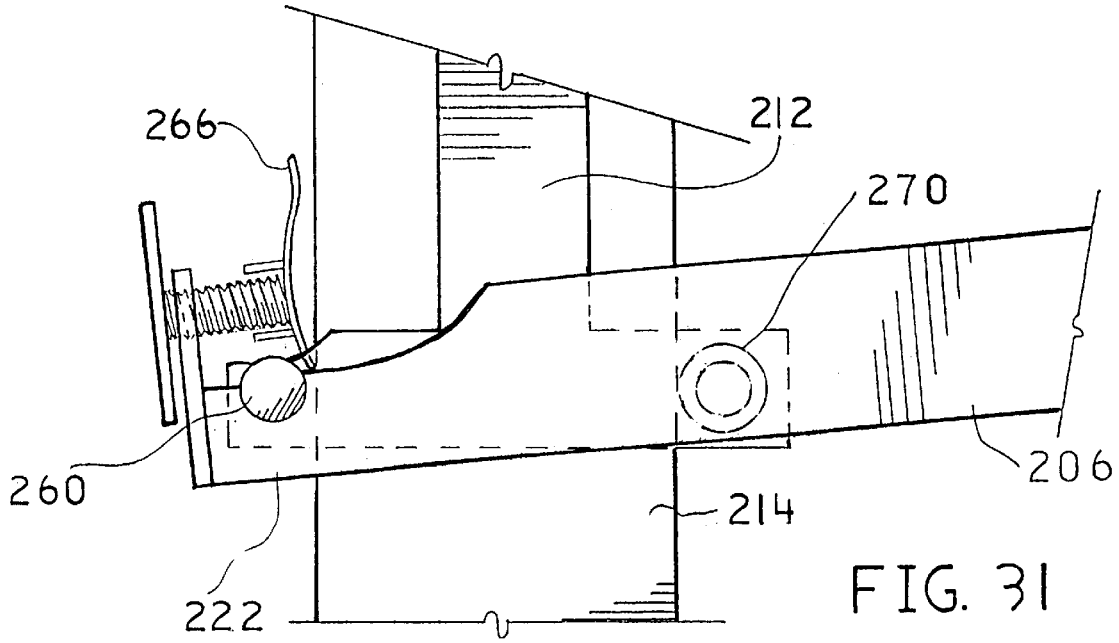
FIG. 31 is an enlarged left side elevational view of the area within the arrow 31 of FIG. 27; and, FIG. 32 is an enlarged top right side exploded perspective view of the frame and counterweight of FIGS. 25 and 26.

On the present embodiment 200, the lock 222 and position of the sleeve 212 is set automatically when the front of the pressure bar 206 is moved to the top of the lumber stack as described more fully in conjunction with FIGS. 30 and 31. When the cam 202 is released and the front of the pressure bar 206 is raised, the automatic lock 222 releases allowing the sleeve 212 to be moved up or down.

Another new feature on the present embodiment 200 is a counter weight (FIGS. 26 and 32) inside the vertical member 214 which balances the weight of the cam 202, brace 204, pressure bar 206, and sleeve 212 assembly allowing the assembly to be easily moved up and down. The counterweight hangs on a cable 224 inside the vertical member 214 which passes over a pulley 226 at the top of the vertical member and is attached to the sleeve 212. It will be appreciated that a similar counterweight assembly could be attached to the prior embodiments 30 and 120 shown in FIGS. 1 and 20, respectively.

FIG. 26 is a left side elevational view of the cam action clamp 200 clamping a stack of lumber 72 similar to FIG. 2A. The height of the clamp is sufficient to allow it to be inserted around two full stacks of lumber as they come from the sawmill. The cam 202 can exert an estimated 2000 pounds of pressure on the front of the pressure bar 206 when the clamp 200 is around a stack as shown in FIG. 26.

FIG. 27 is a partial left side elevational view of the upper portion of the clamp 200. Access to the boards 74 is gained by releasing the cam 202 and raising the pressure bar 206. As the boards 74 are used out of the stack, the pressure bar 206 is progressively lowered with the sleeve 212 to match the top level of the remaining boards.

A counterweight 228 shown in FIG. 26 substantially matches the weight of the cam 202, brace 204, pressure bar 206, and sleeve 212 assembly allowing the assembly to be easily moved up and down with one hand using approximately five pounds of pressure when the clamp is in the released position shown in FIG. 27. The counterweight 228 is coupled to the sleeve 212 by a cable 224 passing over a pulley 226 at the top of the vertical member 214.

FIG. 28 is an enlarged partial front elevational view of FIG. 26 showing the mounting of handle 218 on center bolt 210 of cam 202. A spring 230 around bolt 210 between handle 218 and a nut 232 on the bolt allows the top of the handle to be moved to the right away from the cam drawing a pin 234 out of one of a series of holes in the right side of the cam. These holes 236 can be seen in FIGS. 25 and 29. The purpose of the spring arrangement on the handle 218 and holes 236 is to allow the handle to be rotated around bolt 210 allowing pin 234 to be placed in any of the holes 236 where it is easiest for the operator to use the handle. For example, in FIG. 26, handle 218 is positioned with the pin in a hole placing the handle straight off the side of the cam 202. This allows the operator to easily pull the top of the handle toward himself as he stands to the right of the clamp. After the pressure bar 206 is released as shown in FIG. 27, handle 218 would be pointed down at the feet of the operator if it were left in the same position with respect to cam 202 shown in FIG. 26. This position might cause the handle to be in the way of someone retrieving lumber from the stack 72. Instead, the operator can move the handle to a new position out of the way as shown in FIG. 27. On the other hand, if two stacks of lumber 72 are in the clamp 200, use of the handle 218 might be easiest if it is left in a low position.

FIGS. 26 and 27 also illustrate the operation of a latch 238 and associated cam 202 structure for keeping pressure bar 206 raised when not in use. Latch 238 pivots due to gravity on cam 202 and has a tooth 240 which engages one of two notches 242 or 244 in the side of the cam holder 246 to hold pressure bar 206 up. In FIG. 27, tooth 240 is shown engaging the second notch 244 which maintains pressure bar 206 in a maximum raised position with the bottom of sleeve 212 resting on the top of the stack 72. The first notch 242 raises pressure bar 206 enough to release automatic lock 222 so that the entire cam, pressure bar, brace, and sleeve assembly can be raised on vertical member 214 using counterweight 228 as described below in conjunction with FIGS. 30 and 31. A stop brace 248 assures that the movement of the sleeve is not hindered by an adjacent stack of lumber by maintaining sufficient space for such movement even if clam 200 abuts an adjacent stack at the rear.

Figure 29:
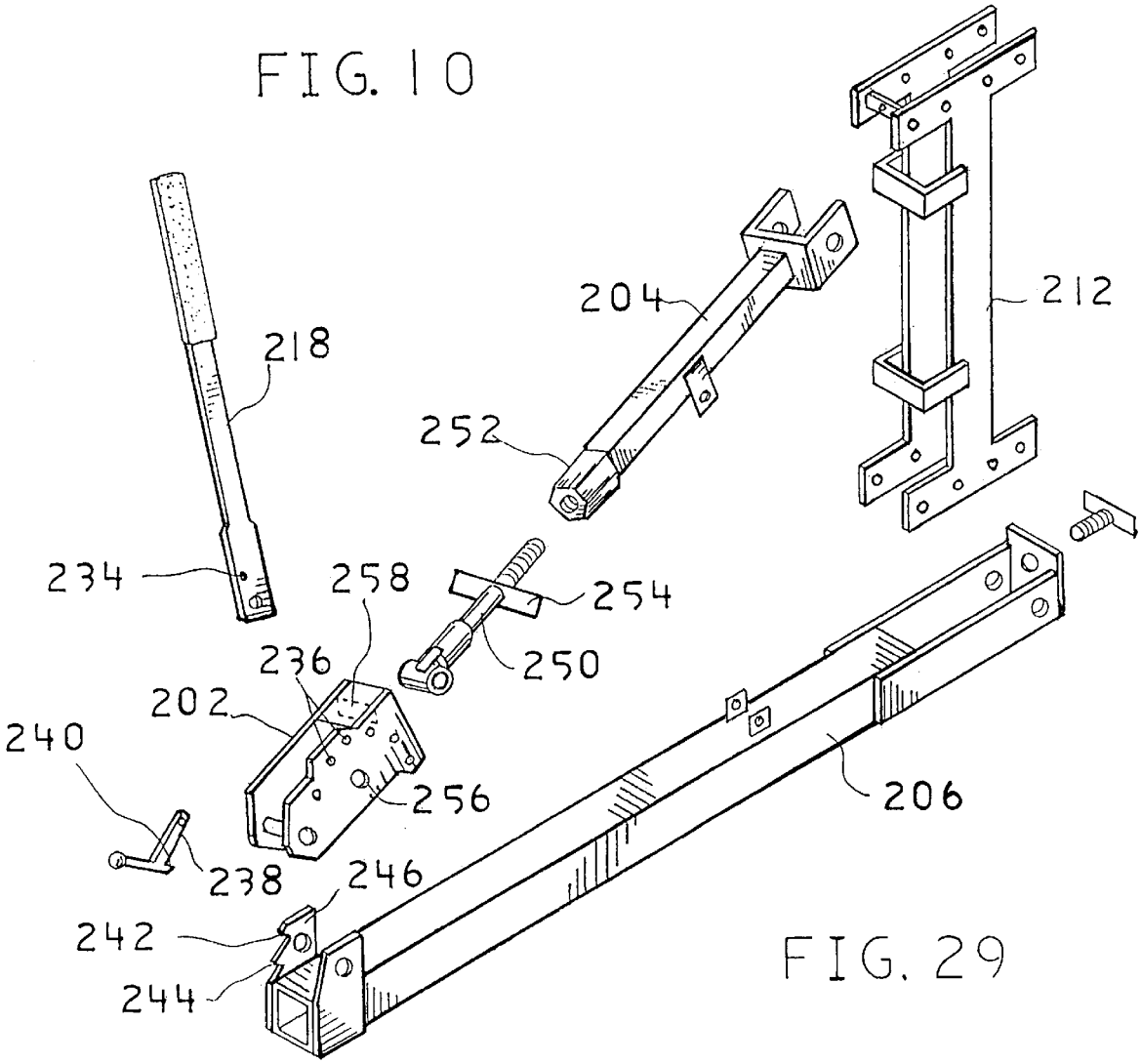
FIG. 29 is an enlarged top right side exploded perspective view of the cam, brace, pressure bar, and sleeve assembly of FIG. 25.

FIG. 29 is an enlarged top right side exploded perspective view of the cam 202, brace 204, pressure bar 206, and sleeve 212 assembly of FIG. 25. The larger scale allows the tooth 240 of latch 238 to be easily seen as well as first notch 242 and second notch 244 on cam holder 246. Also easily seen are pin 234 on handle 218 which operates in one of the series of holes 236 in cam 202 to hold the handle in a desired position. To the right of cam 202 is a threaded tension control 250 which screws into a nut 252 in the end of brace 204 to slightly adjust the overall length of brace 204. Arms 254 on tension control 250 allow the tension control to be easily turned by the operator. The opposite end of the tension control fits around bolt 210 (FIG. 25) which is fitted in hole 256. When the threaded shaft of tension control 250 is rotated by using the arms 254, the left end of the shaft rotates freely and is retained in the opposite end of the tension control. A cam stop 258 represented by dotted outlines inside cam 202 limits rotation of the cam below the center line discussed in conjunction with FIG. 25 when the cam stop hits the top of tension control 250.

FIG. 30 is an enlarged left side elevational view of the area within the arrow 30 of FIG. 26 showing the automatic lock 222. Pressure bar 206 is hinged on vertical member 214 at bolt 260. The front of the pressure bar is to the right and the rear is to the left. A rear portion 262 of the pressure bar extends past bolt 260 and threadibly holds lock bolt 264. Lock bolt 260 carries a leaf spring 266 which presses against vertical member 214 and a lock bolt handle 268 which allows the operator of the clamp to adjust the compression of the spring against the vertical member. Pressure bar 206 moves up and down on vertical member 214 on sleeve 212 as described above to match the various heights of the lumber stacks.

FIG. 31 is an enlarged left side elevational view of the area within the arrow 31 of FIG. 27 showing the lock 222 automatically released when the front end of the pressure bar 206 is raised. The sleeve 212 and pressure bar 206 are free to move up and down on vertical member 214 when leaf spring 266 swivels away from the rear of vertical member 214 around bolt 260. The vertical movement of the sleeve is aided by a roller 270 pressing against the front of the vertical member. A similar roller 271 is visible in FIG. 25 at the top back of sleeve 212.

In order to achieve the position shown in FIG. 31, the front of pressure bar 206 has been raised three inches and is retained in position by latch 238 engaging first notch 242 (FIGS. 26 and 29). When latch 238 is released and the front of pressure bar 206 is moved down by use of cam 202 (FIG. 26), automatic lock 222 engages vertical member 214 sufficiently when the front of pressure bar 206 has moved down one inch to resist movement upward of the rear of pressure bar 206 as the pressure bar moves down against the rear boards. As cam 202 is moved further down, more friction is created between automatic lock 222 and vertical member 214 sufficient to resist further upward movement. When the full three inches of downward travel of the front of pressure bar 206 is achieved as shown in FIG. 30, approximately 2000 pounds is created by cam 202 at the front of pressure bar 206 against the front boards. A scissors action is created thereby which progressively places the boards under pressure from the rear of the stack to the front which requires much less effort by the operator than would a clamp which placed all of the boards under pressure simultaneously.

Figure 32:
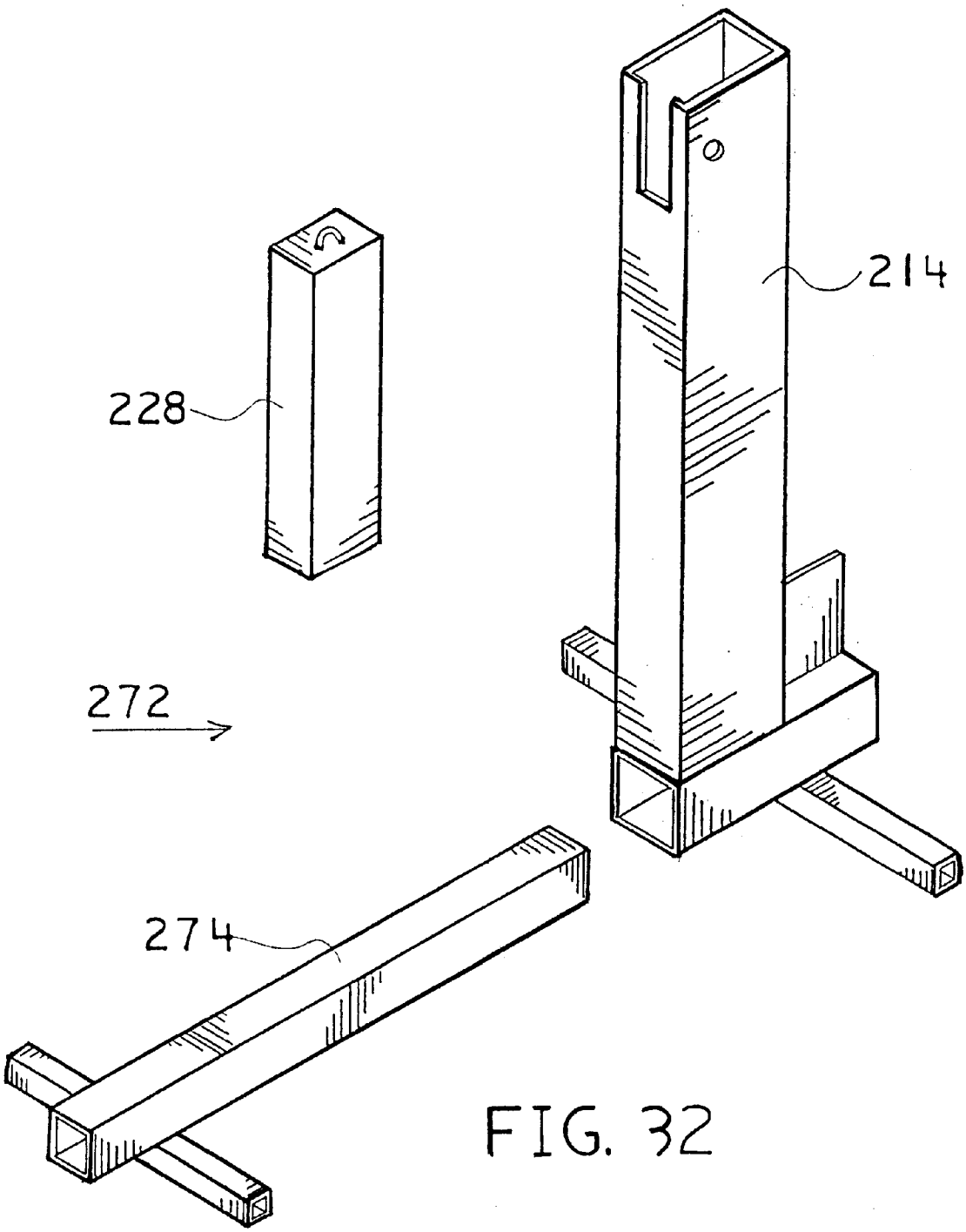

FIG. 32 is an enlarged top right side exploded perspective view of the frame 272 and counterweight 228 of FIGS. 25 and 26. The frame 272 includes the vertical member 214 and a horizontal member 274. The rear end of the horizontal member 274 is removable from a socket in the bottom of the vertical member to facilitate the shipment of the clamp 200. When the horizontal member is inserted into the socket, the vertical member is rigidly coupled to the horizontal member at a substantially right angle to the horizontal member.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A clamp, comprising:

a horizontal member having front and rear ends;

a vertical member coupled to said rear end of said horizontal member;

a pressure bar having front and rear ends;

a rear hinge movably coupling said rear end of said pressure bar to said vertical member; and, means for holding said pressure bar in a fixed position with respect to said horizontal member including a brace between said vertical member and said pressure bar having a cam for increasing the effective length of said brace.

2. A clamp according to claim 1, wherein said vertical member is rigidly coupled to said horizontal member at a substantially right angle to said horizontal member.

3. A clamp according to claim 1, further including a means for selectively moving said rear hinge vertically on said vertical member.

4. A clamp according to claim 3, further including an automatic lock for selectively holding said rear hinge at a desired position on said vertical member by locking said rear hinge at said desired position when said front end of said pressure bar is lowered and releasing said rear hinge from said desired position when said front end of said pressure bar is raised.

5. A clamp according to claim 4, wherein said automatic lock includes said pressure bar having a rear portion behind said vertical member and above said rear hinge for pressing against said vertical member.

6. A clamp according to claim 5, wherein said automatic lock further includes a spring between said rear portion and said vertical member.

7. A clamp according to claim 3, further including a counterweight coupled to said pressure bar for substantially offsetting the weight of said pressure bar when moved vertically on said vertical member.

8. A clamp, comprising:

a horizontal member having front and rear ends;

a vertical member coupled to said rear end of said horizontal member;

a pressure bar having front and rear ends;

a rear hinge movably coupling said rear end of said pressure bar to said vertical member;

a means for selectively moving said rear hinge vertically on said vertical member having an automatic lock for selectively holding said rear hinge at a desired position on said vertical member by locking said rear hinge at said desired position when said front end of said pressure bar is lowered and releasing said rear hinge from said desired position when said front end of said pressure bar is raised; and, means for holding said pressure bar in a fixed position with respect to said horizontal member including a brace between said vertical member and said pressure bar.

9. A clamp according to claim 8, wherein said vertical member is rigidly coupled to said horizontal member at a substantially right angle to said horizontal member.

10. A clamp according to claim 8, wherein said automatic lock includes said pressure bar having a rear portion behind said vertical member and above said rear hinge for pressing against said vertical member.

11. A clamp according to claim 10, wherein said automatic lock further includes a spring between said rear portion and said vertical member.

12. A clamp, comprising:

a horizontal member having front and rear ends;

a vertical member coupled to said rear end of said horizontal member;

a pressure bar having front and rear ends;

a rear hinge movably coupling said rear end of said pressure bar to said vertical member;

means for selectively moving said rear hinge vertically on said vertical member;

a counterweight coupled to said pressure bar for substantially offsetting the weight of said pressure bar when moved vertically on said vertical member; and, means for holding said pressure bar in a fixed position with respect to said horizontal member including a brace between said vertical member and said pressure bar.

* * * * *